US007766660B1

(12) United States Patent
Chang

(10) Patent No.: US 7,766,660 B1
(45) Date of Patent: Aug. 3, 2010

(54) ELECTRICAL CONNECTOR HOUSING

(75) Inventor: Tung Ya Chang, Chungho (TW)

(73) Assignee: Linshiung Enterprise Co., Ltd., Danshuei Township (TW)

( * ) Notice: Subject to any disclaimer, the term of this patent is extended or adjusted under 35 U.S.C. 154(b) by 0 days.

(21) Appl. No.: 12/554,018

(22) Filed: Sep. 4, 2009

(51) Int. Cl.
*H01R 39/00* (2006.01)

(52) U.S. Cl. ..... 439/11; 439/31; 439/165; 439/654; 439/534; 439/954

(58) Field of Classification Search ..... 439/8, 439/11, 13, 31, 165, 534, 640, 654, 954
See application file for complete search history.

(56) References Cited

U.S. PATENT DOCUMENTS 6,162,094 A 12/2000 Huang
6,176,746 B1 1/2001 Morello et al.
6,722,892 B1 * 4/2004 Blakelock ..... 439/31
6,893,267 B1 * 5/2005 Yueh ..... 439/8
6,991,467 B1 * 1/2006 Cheng et al. ..... 439/10
7,025,595 B1 * 4/2006 Chan et al. ..... 439/6
7,066,753 B1 * 6/2006 Tseng ..... 439/259
7,128,615 B1 * 10/2006 Liao ..... 439/640
7,374,425 B1 * 5/2008 Kuo et al. ..... 439/31
2008/0090456 A1 4/2008 Bernat et al.

* cited by examiner

*Primary Examiner*—James Harvey
(74) *Attorney, Agent, or Firm*—Morris, Manning & Martin LLP; Tim Tingkang Xia

(57) ABSTRACT

The present invention is an electrical connector housing comprising a central segment and two connector holders. The central segment has two sides and two wings. The wings are formed respectively on and protrude respectively from the sides of the central segment, and each wing has parallel grooves. The connector holders are mounted pivotally respectively on the wings, and each connector holder has a notch. Each notch has two edges and two tracks. The tracks are formed respectively near the edges, are mounted pivotally respectively in the grooves and enable the connector holder to pivot up to 180 degrees relative to the central segment.

4 Claims, 6 Drawing Sheets

ELECTRICAL CONNECTOR HOUSING

FIELD OF THE INVENTION

An electrical connector housing in accordance with the present invention is able to pivot 360 degrees.

BACKGROUND OF THE INVENTION

More and more electrical products have multiple functions, but electrical products manufactured by different companies may be manufactured to different specifications. For example, a memory card may have an SD, XD or FD interface specification, and a connector may be manufactured to a Universal Serial Bus (USB), Recommended Standard-232 (RS232), Personal Computer Memory Card International Association (PCMCIA) or Express Card interface specification. A corresponding reader or connector is required to connect these electrical products to a computer to read information stored in the particular electrical product.

Most current connectors have a fixed physical configuration (i.e. straight or elbow shaped) and cannot be used in confined spaces.

SUMMARY OF THE INVENTION

The objective of the present invention is to provide an electrical connector housing with multiple physical configurations.

An electrical connector housing in accordance with the present invention comprises a central segment and two connector holders. The central segment has two sides and two wings. The wings are formed respectively on and protrude respectively from the sides of the central segment, and each wing has parallel grooves. The connector holders are mounted pivotally respectively on the wings, and each connector holder has a notch. Each notch has two edges and two tracks. The tracks are formed respectively near the edges, are mounted pivotally respectively in the grooves and enable the connector holder to pivot up to 180 degrees relative to the central segment.

BRIEF DESCRIPTIONG OF DRAWINGS

DETAILED DESCRIPTION OF THE PRESENT INVENTION

Figure 1:
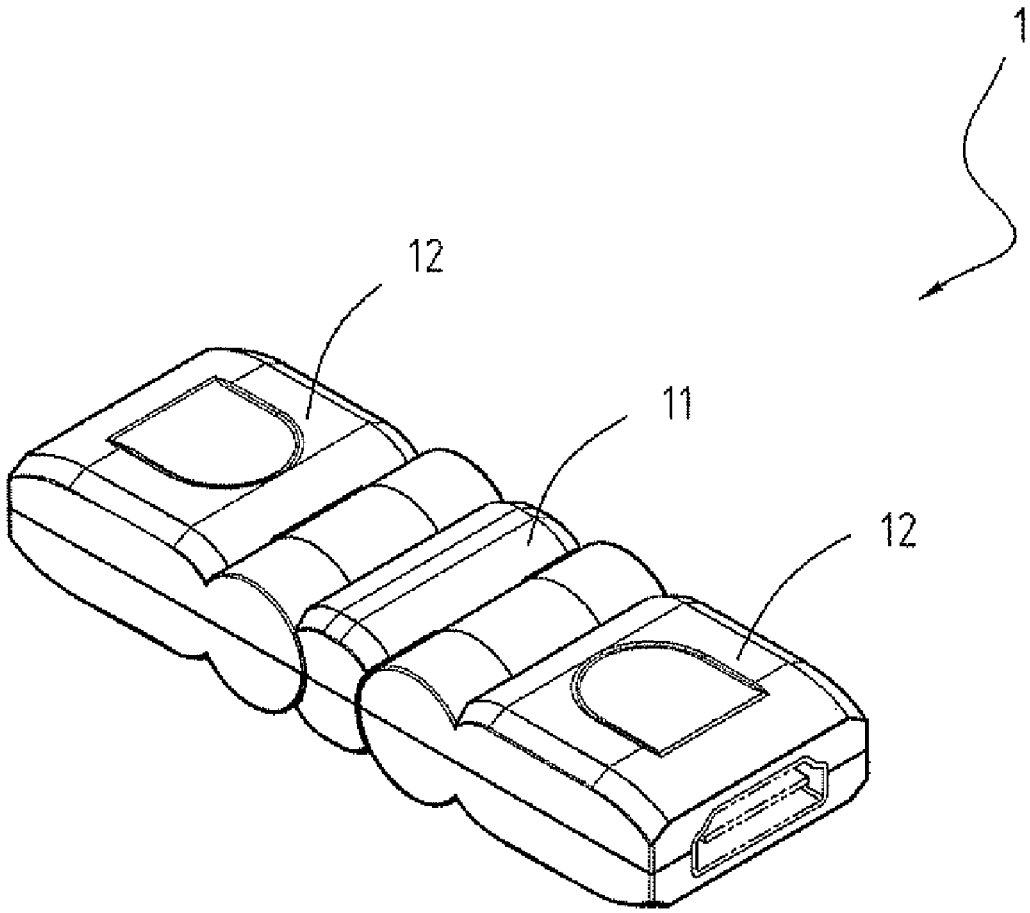
FIG. 1 is a perspective view of a first embodiment of an electrical connector housing in accordance with the present invention.
Figure 2:
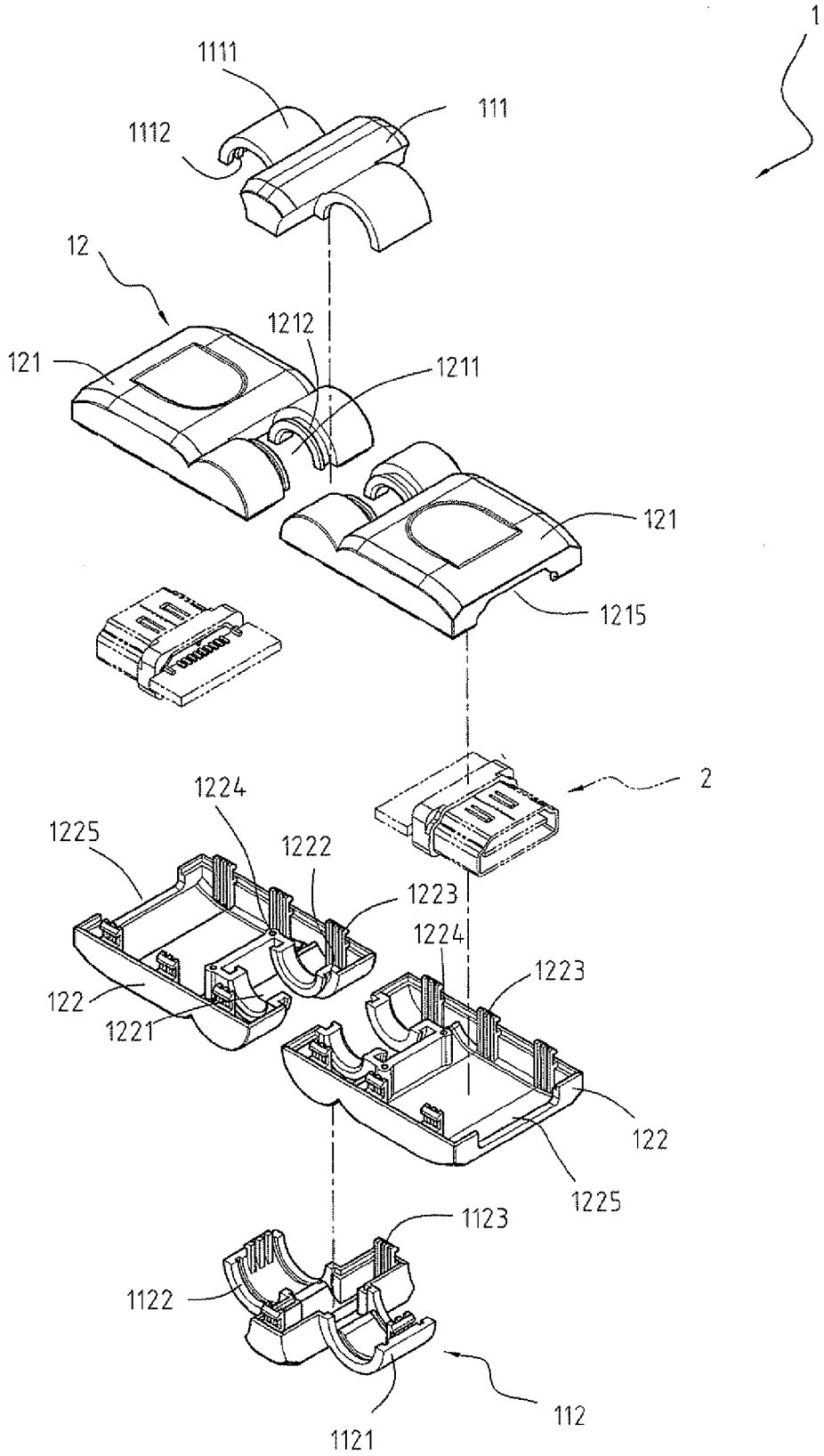
FIG. 2 is an exploded perspective view of the electrical connector housing in FIG. 1.
Figure 3:
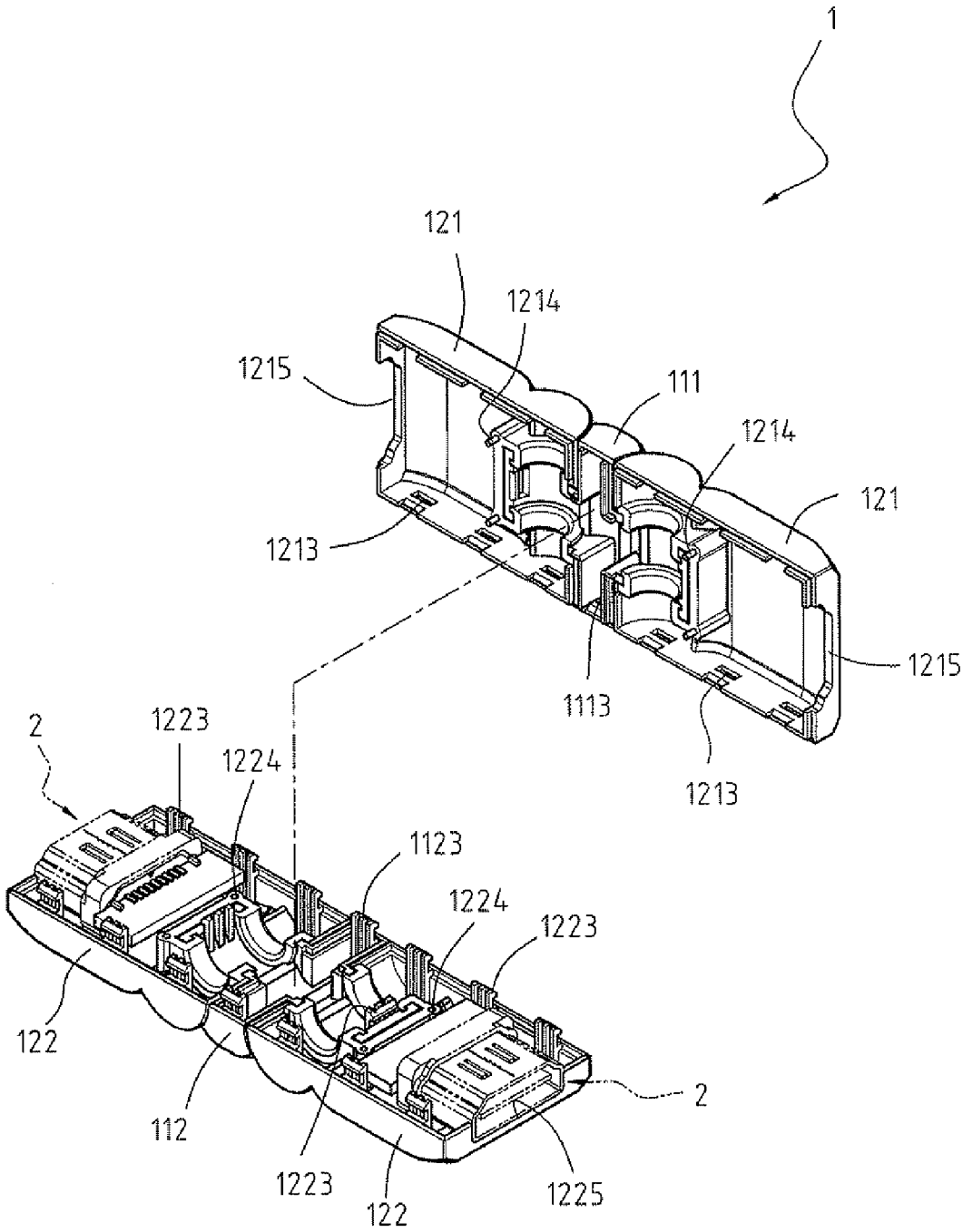
FIG. 3 is a partially exploded perspective view of the electrical connector housing in FIG. 1.
Figure 4:
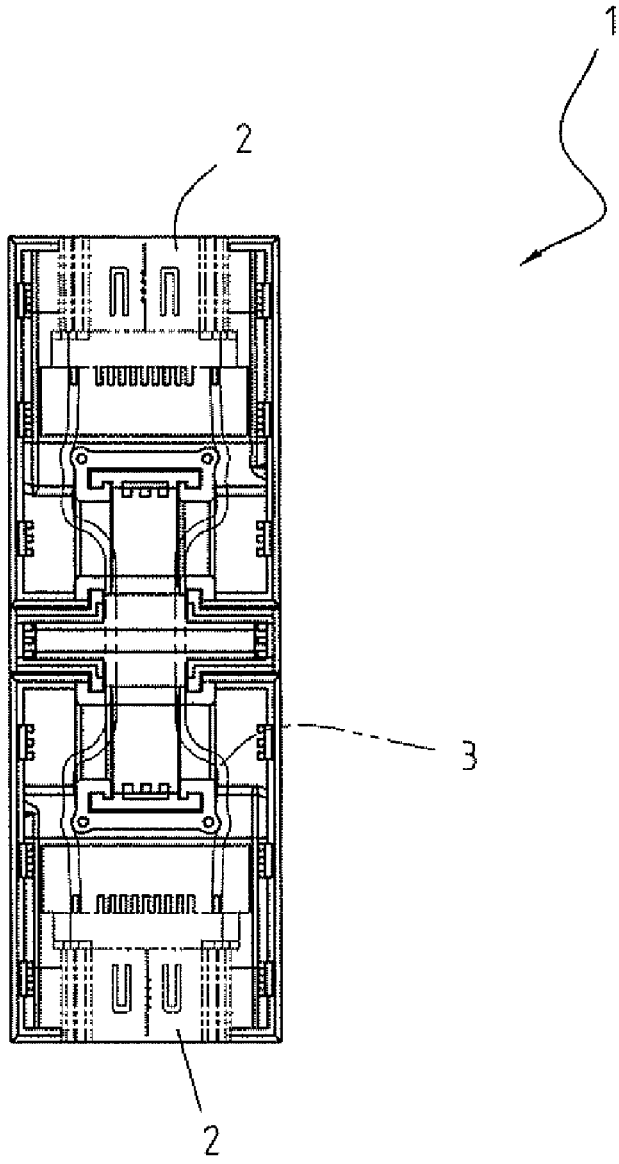
FIG. 4 is a top internal view of the electrical connector housing in FIG. 1.
Figure 5:
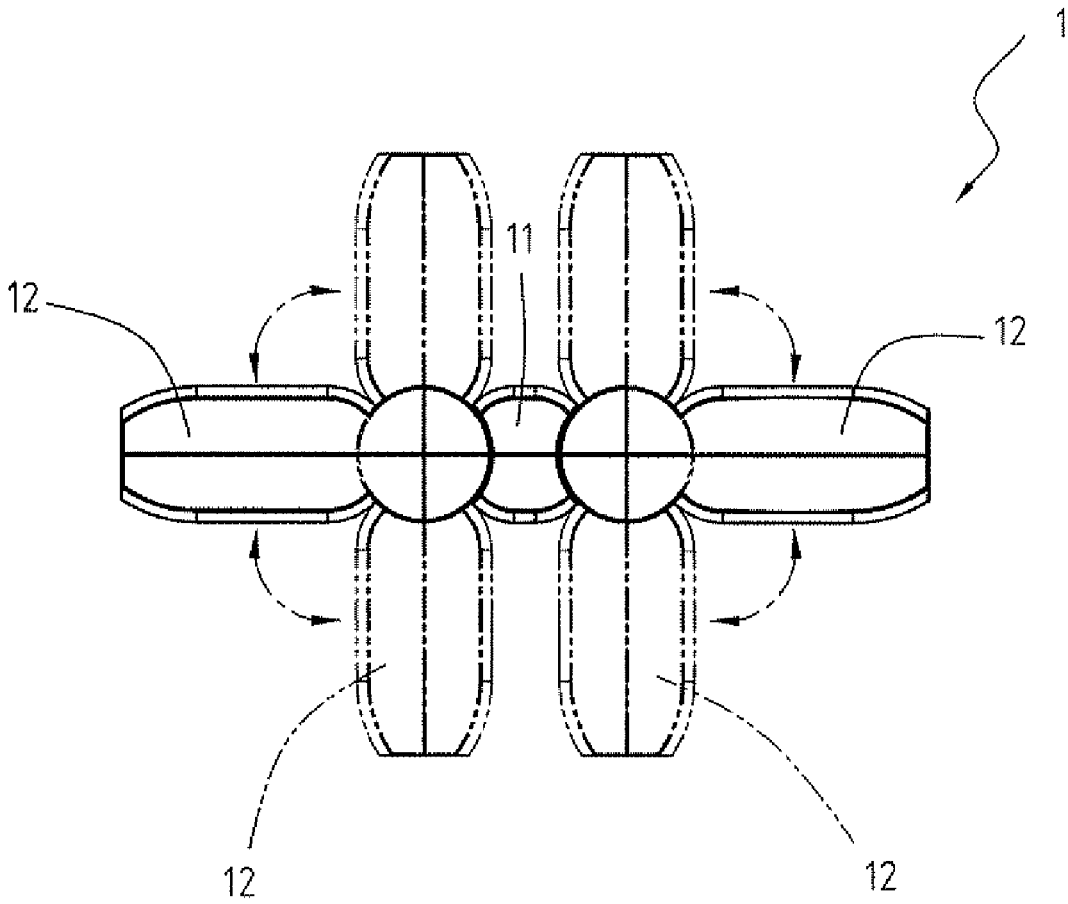
FIG. 5 is an operational side view of the electrical connector housing in FIG. 1
Figure 6:
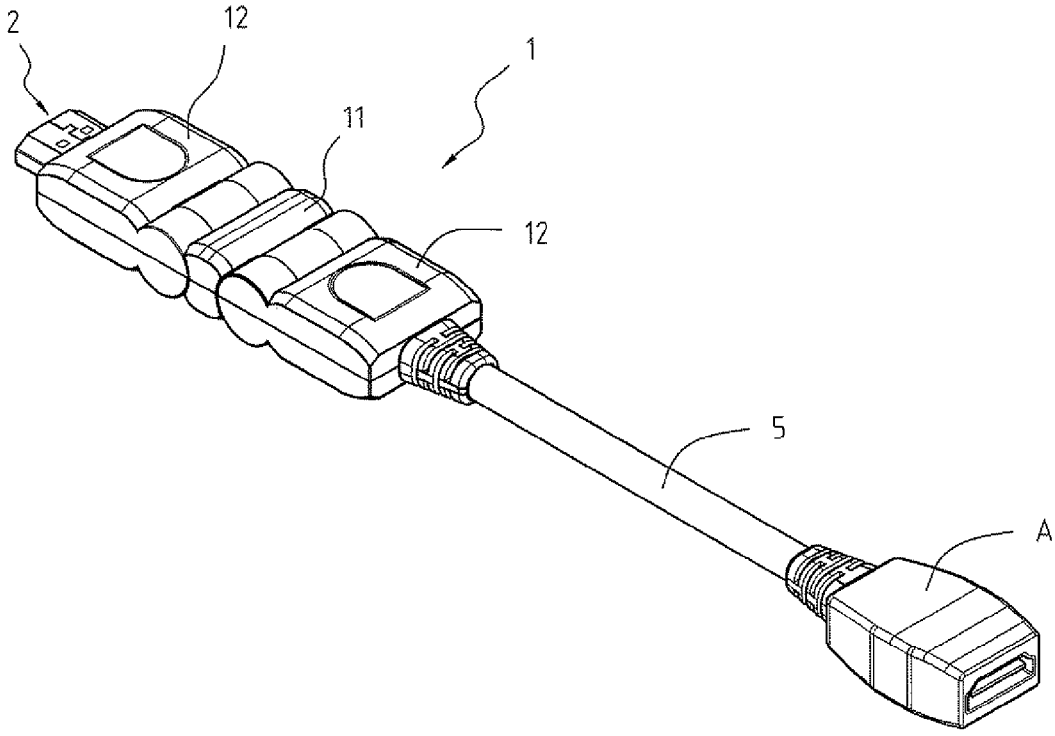
FIG. 6 is a perspective view of a second embodiment of an electrical connector housing in accordance with the present invention with an external connector.

With reference to FIGS. 1 to 6, an electrical connector housing (1) in accordance with the present invention comprises a central segment (11), two connector holders (12) and holds two connectors (2).

The central segment (11) is hollow and comprises an upper casing (111) and a lower casing (112), The upper casing (111) is semicylindrical, has an outer surface, an inner surface, two ends and two edges and comprises two wings (1111), multiple grooves (1112) and multiple latches (1113). The wings (1111) are formed respectively on and protrude respectively from the two edges of the upper casing (111), and each wing (1111) has an inner surface, an outer end and two edges. The grooves (1112) are formed in the inner surface of the wings (1111) respectively adjacent to the edges. The latches (1113) are formed in the upper casing (111) and comprise slight protrusions.

The lower casing (112) is semicylindrical, has an outer surface, an inner surface, two ends and two edges, connects to the upper casing (111) and comprises two wings (1121), multiple grooves (1122) and multiple connecting hooks (1123). The wings (1121) are formed respectively on and protrude respectively from the two edges of the lower casing (112), and each wing (1121) has an inner surface, an outer end and two edges. The grooves (1122) are formed in the inner surface of the wings (1121) respectively adjacent to the edges. The connecting hooks (1123) are formed on and protrude from the lower casing (112), align respectively with and engage the latches (1113) to connect the lower casing (112) to the upper casing (111).

The connector holders (12) are hollow, and each connector holder (12) comprises an upper holder (121) and a lower holder (122).

The upper holder (121) has an inner surface and comprises an upper inner notch (1211) and an upper outer notch (1215).

The inner surface has two longitudinal edges and an optional division wall. Each longitudinal edge has multiple latches (1213). The latches (1213) protrude in slightly from the longitudinal edges. The division wall is formed toward the inner end and has multiple alignment protrusions (1214).

The upper inner notches (1211) connect respectively to the wings (1111, 1121) of the central segment (11), and each notch (1211) has two tracks (1212). The tracks (1212) align respectively with and are mounted slideably respectively in the grooves (1112) of the upper casing (111) and enable the connector holders (12) to pivot 180 degree relative to the central segment (11). Therefore, the connector holders (12) can pivot 360 degrees relative to each other.

The upper outer notches (1215) are formed between the two longitudinal edges and opposite respectively to the upper inner notches (1211).

The lower holder (122) has an inner surface and comprises a lower inner notch (1221) and a lower outer notch (1225).

The inner surface has two longitudinal edges and an optional division wall. Each longitudinal edge has multiple connecting hooks (1223). The connecting hooks (1223) align respectively with and connect respectively to the latches (1213). The division wall is formed adjacent to the inner end and has multiple alignment holes (1224). The alignment holes (1224) align respectively with and connect respectively to the alignment protrusions (1214).

The lower inner notch (1221) is connected pivotally to the wings (1121) of the lower casing (112) and has two tracks (1222). The tracks (1222) are mounted respectively in the grooves (1122) of the lower casing (112).

The lower outer notches (1225) are formed between the two longitudinal edges opposite respectively to the inner notches (1221) and forms outer openings respectively with the upper outer notches (1215).

The connectors (2) are mounted respectively in the outer openings of the electrical connector housing (1), are connected by wires and are selected from a group consisting of a plug, a receptacle and an external connector.

What is claimed is:

1. An electrical connector housing comprising a central segment being hollow and comprising an upper casing being semicylindrical, having an outer surface, an inner surface, two ends and two edges and comprising two wings being formed respectively on and protruding respectively from the two edges of the upper casing, and each wing having an inner surface, an outer end and two edges;

multiple grooves being formed in the inner surface of the respectively adjacent to the edges; and multiple latches being formed in the upper casing and comprising slight protrusions; and a lower casing being semicylindrical, having an outer surface, an inner surface, two ends and two edges, connecting to the upper casing and comprising two wings being formed respectively on and protruding respectively from the two edges of the lower casing, and each wing having an inner surface, an outer end and two edges;

multiple grooves being formed in the inner surface of the wings respectively adjacent to the edges; and multiple connecting hooks being formed on and protruding from the lower casing, aligning respectively with and engaging the latches to connect the lower casing to the upper casing; and two connector holders being hollow, and each connector holder comprising an upper holder having an inner surface having two longitudinal edges, each longitudinal edge having multiple latches protruding in slightly from the longitudinal edges, and the upper holder comprising an upper inner notch, the upper inner notches connecting respectively to the wings of the central segment, and each notch having two tracks aligning respectively with and being mounted slideably respectively in the grooves of the upper casing; and an upper outer notch, the upper outer notches being formed between the two longitudinal edges and opposite respectively to the upper inner notches; and a lower holder having an inner surface having two longitudinal edges, each longitudinal edge having multiple connecting hooks aligning respectively with and connecting respectively to the latches, and the lower holder comprising a lower inner notch being connected pivotally to the protruding wings of the lower casing and having two tracks being mounted respectively in the grooves of the lower casing; and a lower outer notch being formed between the two longitudinal edges opposite respectively to the inner notch and forming outer openings respectively with the upper outer notches; and holding two connectors being mounted respectively in the outer openings of the electrical connector housing and being connected by wires.

2. The electrical connector housing as claimed in claim 1, wherein the inner surface of the upper holder and the lower holder further comprise a division wall being formed adjacent to the inner notches.

3. The electrical connector housing as claimed in claim 1, the connector being selected from the group consist of: a plug, a receptacle and an external connector.

4. The electrical connector housing as claimed in claim 2, wherein each division wall on an upper holder has multiple alignment protrusions; and each division wall on a lower holder has multiple alignment holes aligning respectively with and connecting respectively to the alignment protrusions.

* * * * *